United States Patent [19]

Aspy

[11] 4,388,760

[45] Jun. 21, 1983

[54] MARKING DEVICE

[75] Inventor: Robert M. Aspy, Stanhope, N.J.

[73] Assignee: Congoleum Corporation, Kearny, N.J.

[21] Appl. No.: 326,970

[22] Filed: Dec. 3, 1981

[51] Int. Cl.[3] ..... B43L 13/02

[52] U.S. Cl. ..... 33/42

[58] Field of Search ..... 33/42, 18 R, 32 R, 32 B, 33/32 C, 43, DIG. 20; 30/286, 289, 314, 298, 164.9, 329, 332, 51

[56] References Cited

U.S. PATENT DOCUMENTS

| | | | |
|---|---|---|---|
| 2,296,232 | 9/1942 | Drain | 30/289 |
| 2,414,408 | 1/1947 | Gauazin | 30/289 |
| 3,184,843 | 5/1965 | Lurie | 30/289 |
| 3,439,419 | 4/1969 | Fleming | 30/289 |
| 3,509,633 | 5/1970 | Fernandes | 30/289 |
| 4,091,537 | 5/1978 | Stevenson, Jr. | 30/286 |

*Primary Examiner*—Willis Little

*Attorney, Agent, or Firm*—Richard T. Laughlin; Walter Katz

[57] ABSTRACT

A wall edge marking device for resilient floor coverings for aiding in cutting the floor covering to size. The marking device has a relatively smooth base surface capable of sliding along the surface of a resilient floor covering which is laid out on a floor area and extends beyond the area to be covered and up a wall surface. An upright surface extends in a plane substantially normal to that of the base surface. The upright surface is biased back on each side to form a pair of angular faces. The apex of the angular faces contacts the wall and slides along the surface of the floor covering overlapping the wall. The intersection of the base and upright surfaces is rounded and has an adjustable marker protruding therefrom. The device slides along the floor, against the wall, where it will trace a mark on the floor covering. This mark can be used as a cutting line for cutting the flooring for an accurate fit. The mark is adjustable in the vertical plane, to compensate for various thicknesses of flooring.

3 Claims, 13 Drawing Figures

MARKING DEVICE

FIELD OF THE INVENTION

The present invention relates to a wall edge marking device for use in fitting a resilient flooring to a floor area. The device enables a person to markout a line on the flooring along which the flooring can be cut to provide an accurate fit with adjacent wall or cabinet surface.

THE BACKGROUND OF THE INVENTION

In the installation of resilient floor covering, wall to wall, it is always very desirable that the cut edges of the resilient flooring exactly and precisely abutt the walls leaving gaps of sufficient width to allow a neat fit with sufficient area for expansion caused by changing weather conditions.

Devices which will cut resilient flooring have been known in the prior art. Most of these devices are costly to construct and require a great deal of training before use. An inexperienced user may destroy the flooring by making a faulty cut, as initial errors are irreversable.

THE PURPOSE AND OBJECT OF THE INVENTION

The principal purpose and object of the present invention is to provide a marking device which can mark out an accurate line along resilient flooring laid out on the floor and partially up the wall. Another object is to provide such a device which can be used to cut out the flooring for an accurate fit, leaving sufficient area to allow for expansion. A further object is to provide such a device which can be easily and inexpensively constructed and can be used with little or no prior experience in cutting or trimming floor covering.

BRIEF SUMMARY OF THE INVENTION

It has been found that these purposes and objects of the present invention, as well as other purposes and advantages of the invention will become clear from a further reading and understanding of the following description.

A marking device for resilient floor coverings is provided having a body portion, handle and an adjustable marker. The body portion comprises a flat, smooth base surface for contacting the surface of the floor covering, laid over the area of installation. A narrow upright surface extends upwardly in a plane substantially normal to that of the base surface. The upright surface is biased back on each side to form a pair of angular faces, the apex of the angular surface is used for contact with the floor covering as it rests against the wall or upright surface wall. The intersection of the base surface and angular surfaces is rounded and has an adjustable marker extending therefrom for marking a line on the floor covering to be installed.

Resilient flooring is laid out so that it extends partially up the wall or cabinet base. The marking device is positioned so that the flat, smooth surface contacts the floor covering on the floor and the upright surface contacts the floor covering on the wall. In this position, pressing against the upturned resilient flooring, the marking device is slid along the floor while being pressed against the wall. The extending marker will mark a line on the flooring somewhere along the upturned portion of the flooring. When the floor covering is cut along this line, and laid out flat the flooring will satisfactorily fit along the wall allowing the proper gap for expansion of the floor covering.

DETAILED DESCRIPTION OF THE INVENTION

Figure 1:
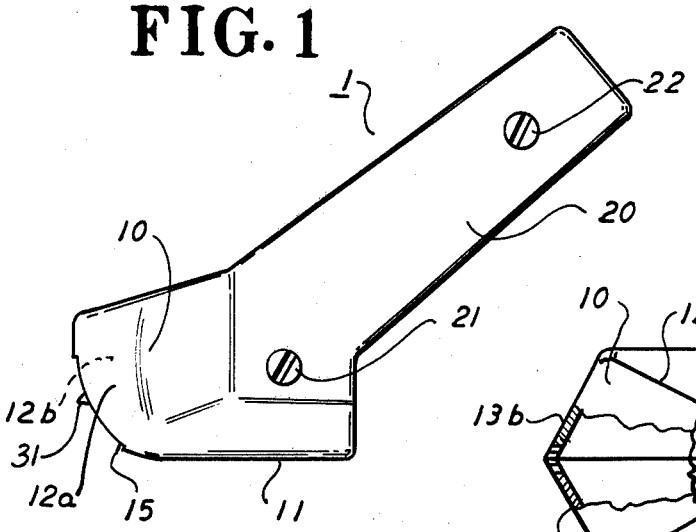
FIG. 1 shows in side elevation the wall edge marker of the present invention.
Figure 2:
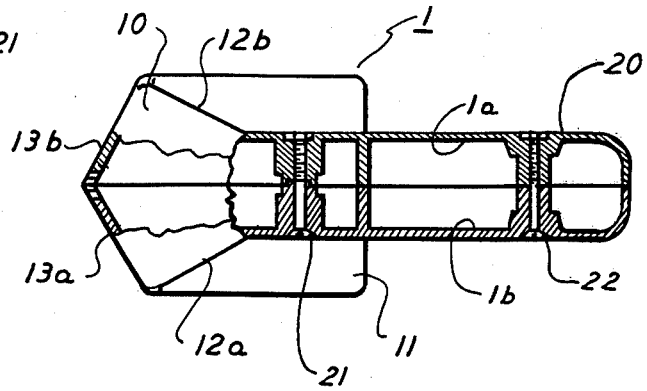
FIG. 2 shows in top elevation, partially in section the wall edge marker of FIG. 1.

In FIGS. 1 and 2 there is shown a wall edge marker generally indicated at 1, having a body portion 10 and handle 20. The body portion 10 comprises a horizontal flat planar, relatively smooth base surface 11; a pair of separately extending side walls **12*a* and 12*b*, which are recessed from the edge of surface 11; a pair of front faces 13*a* and 13*b* which meet at an apex forming an angle of about 140° there between. Front faces 13*a* and 13*b* lie in planes which intersect the plane of flat base surface 11 at right angles. At this intersection, a relatively smooth, curved or arcuate surface 15 is provided for smoothly connecting horizontal base surface 11 to the substantially vertical front faces 13*a* and 13*b***.

The curved or arcuate surface 15 is formed at a quarter of a right regular cylinder. The base surface 11 possesses sufficient horizontal surface extending past sidewalls **12*a* and 12*b* on each side and is sufficiently planar that it is capable of smoothly and easily sliding in a steady, stable, non-rocking fashion along the surface of a resilient floor covering which is being laid out along the floor. A rectangular handle 20 extends upward at approximately a 45° angle from the body portion 10, to allow the user to push or pull the marking device 1** along the flooring.

Figure 4:
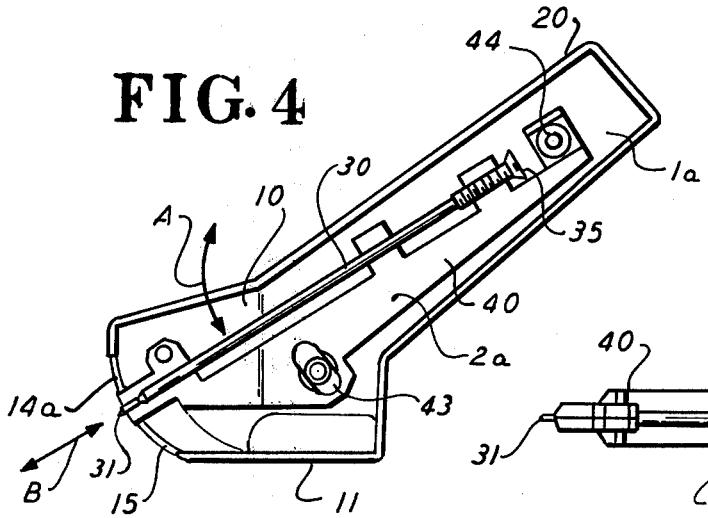
FIG. 4 shows in side elevation, the pen in place in one half of the pen receptacle which is in turn in place on one half of the marking device of the present invention.
Figure 3:
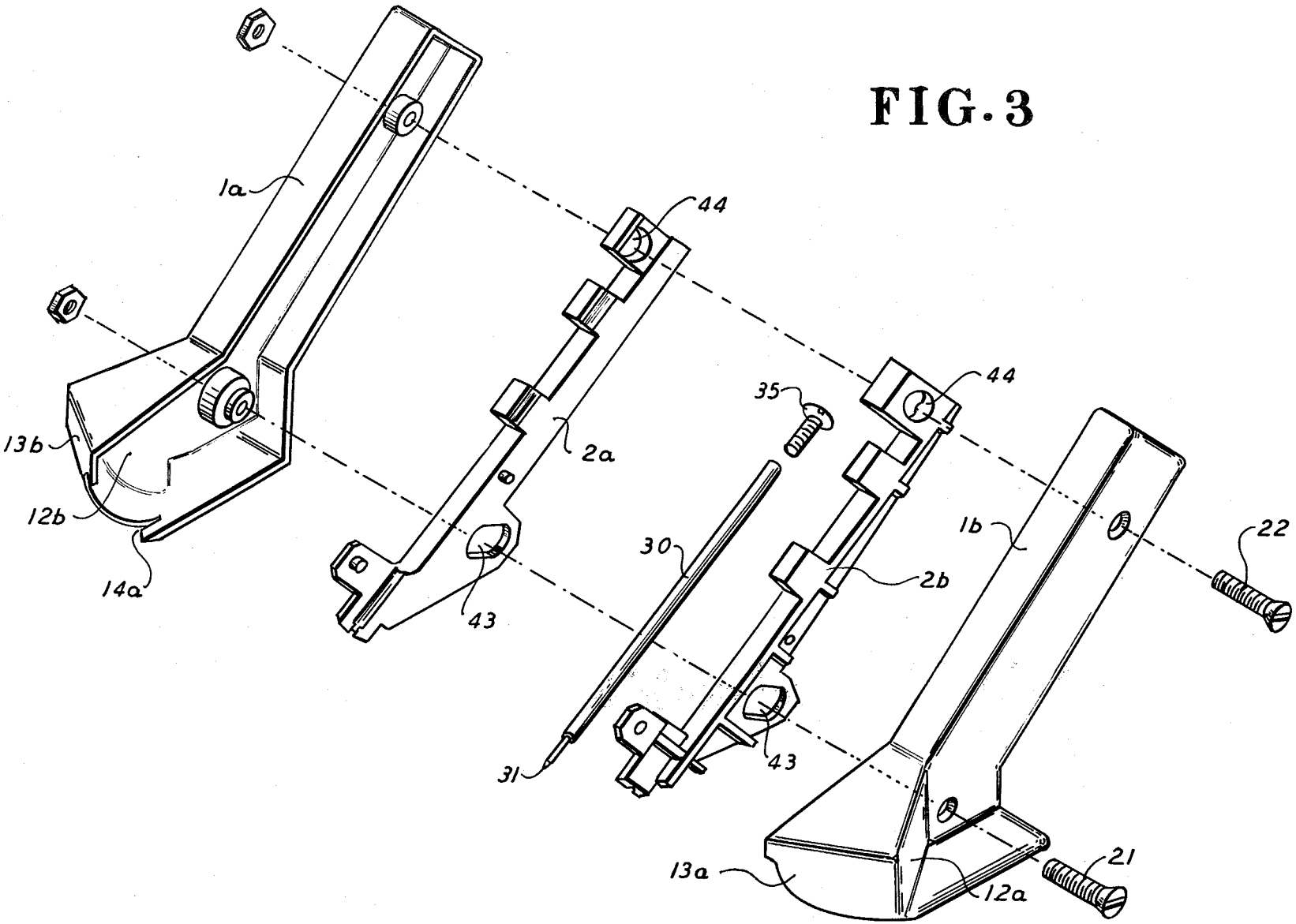
FIG. 3 shows in exploded view the wall edge marker of the present invention, including pen, pen receptacle, set screw and securing bolts.
Figure 7:
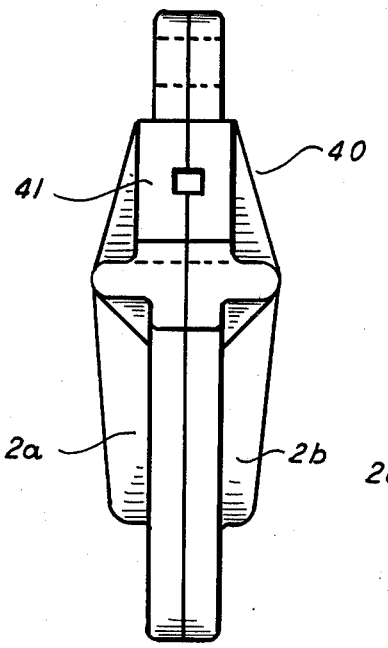
FIG. 7 is a cross section view of the wall edge marker shown in FIG. 6 taken along line 7-7'.
Figure 8:
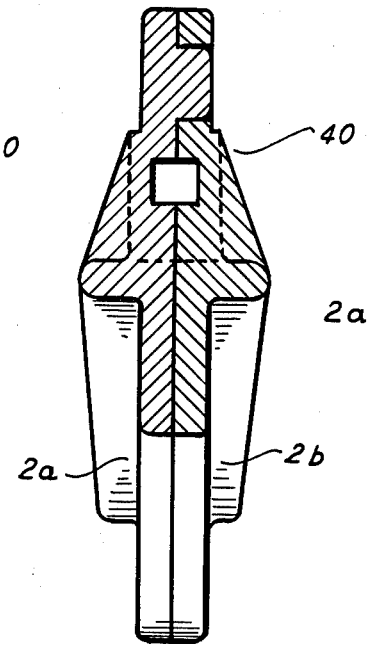
FIG. 8 is a cross sectional view of the wall edge marker shown in FIG. 6 taken along line 8-8'.
Figure 9:
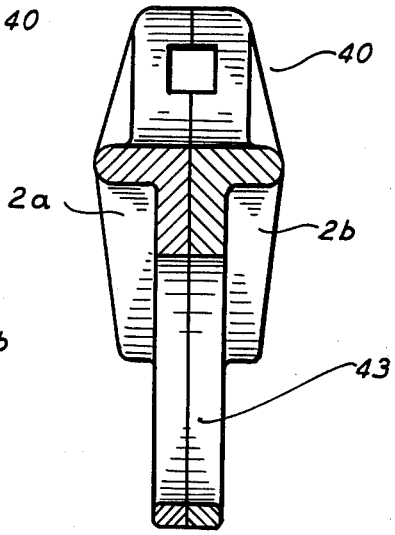
FIG. 9 is a cross sectional view of the wall edge marker shown in FIG. 6 taken along line 9-9'.
Figure 10:
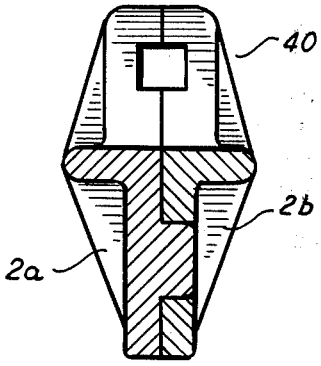
FIG. 10 is a cross sectional view of the wall edge marker shown in FIG. 6 taken along line 10-10'.
Figure 11:
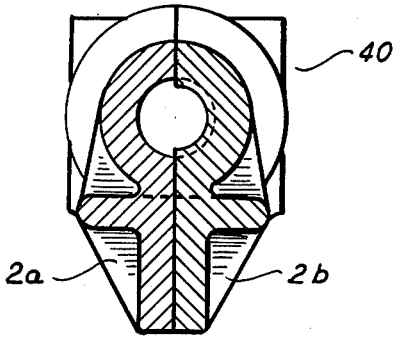
FIG. 11 is a cross sectional view of the wall edge marker shown in FIG. 6 taken along line 11-11'.
Figure 12:
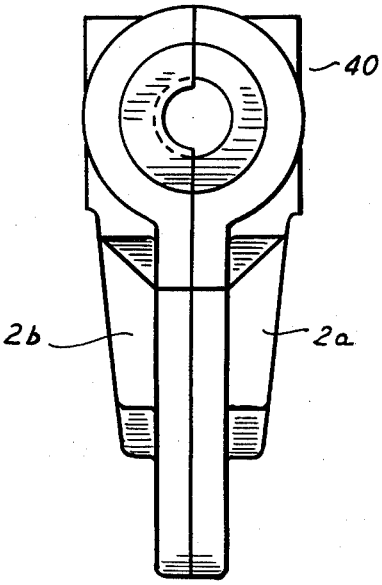
FIG. 12 is a cross sectional view of the wall edge marker shown in FIG. 6 taken along line 12-12'.

As can be seen from FIGS. 2, 3 and 4, the housing wing of the marking device is made of two outer sections **1*a* and 1*b*, and two inner sections 2*a* and 2*b*, also being mirror immage of each other. The outer and inner sections may be secured together by conventional bolts and screws 21 and 22** which extend through each of the sections.

Centrally located on the smooth arcuate surface 15 is a vertical slot or notch 14*a*, through which extends a pen or similar marker device 30 which is used to provide the desired line or mark on the floor covering. The Pen 30, is held in place by a pen receptacle 40 (shown in detail in FIGS. 3, 4, and 5) which is formed in the two inner sections 2*a* and 2*b*.

Figure 5:
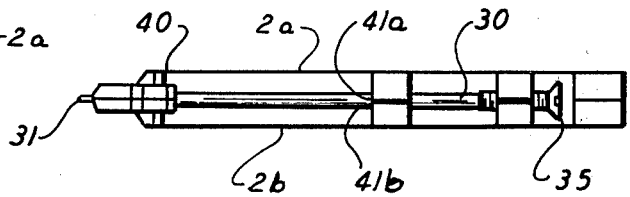
FIG. 5 shows the pen receptacle of FIGS. 3 and 4 holding the pen in position.
Figure 6:
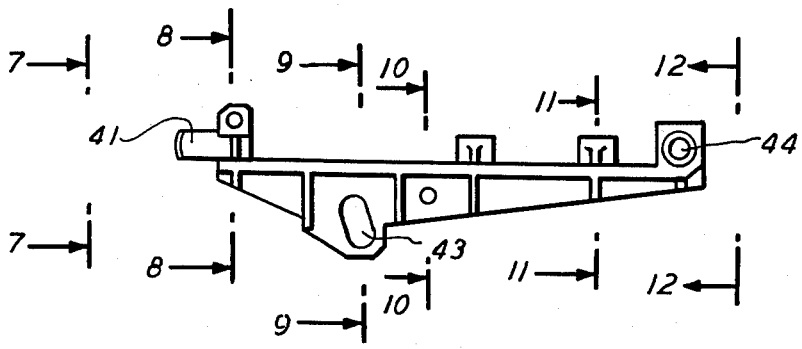
FIG. 6 is a side elevation of the marker of the present invention, illustrating the principals involved in its edge.

Pen receptacle 40 has a pen receiving slot 41*a* and 41*b*, which hold the pen 15 in place. As indicated the two piece pen receptacle 40 is held slideably in place by the same screws and bolts 21 and 22 which secure the two outer sections of the marking device housing. These screws 21 and 22 are placed through a pair of "eyes" 43; at the front of the pen and 44 at the rear. The front eye 43 is elliptical, so that the front of the pen receptacle can be moved back and forth, pivoting about the circular eye 44 which holds the rear portion in place. Before the screws 21 and 22 are tightly secured, the marking end of the pen 30, can be adjusted vertically to place the pen in the desired extending position, depending on the thickness of the floor, and the fit desired will be described hereinafter. The distance at which the pen 30 extends, extends from the marking device 1, may also be adjusted to provide the desired precision of marking. When enclosed in the two inner sections of the pen receptacle 40, the pen can be moved forward by inverting a set screw 35 at the top/rear portion of the receptacle. By adjusting the set screw 35, the pen 30 will be forced forward thereby extending the distance at which the pen 30 extends from the marking device 1. FIG. 5 shows in top view the pen 30 in place in the two sections of the pen receptacle 40, set screw 35 upon inward rotation will force the writing edge 31 of the pen 30 further out.

FIG. 4 shows pen 30 in place in one half of the pen receptacle 2*a* which is in turn in place in one half of the marker housing 1*a*. In this position and before the second section is secured to the first, the pen 30 may be adjusted both as to its height, by pivoting the pen receptacle (as shown by arrow "A"), and as to its extension by adjusting set screw 35 (as shown by arrow "B".)

The second section now can be attached to the first and when the screws are tightened, the pen 30 will be locked into a pre-set position.

The Use of the Wall Edge Marker

Figure 13:
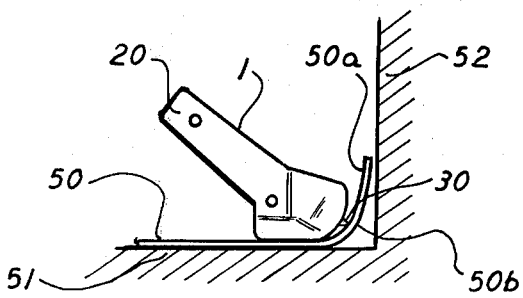
FIG. 13 is a plan view showing the wall edge marker in position marking a floor covering.

The use of the wall edge marking device is shown in FIG. 13. With the resilient flooring laid 50 out flat on the floor 51 with a relatively short portion 50*a* thereof curled partly up along a wall 52, the assembled wall marker 1 is brought into contact with the upwardly curled edge portion of the floor covering, so that the pen 30 contacts the curled edge and the base surface 11 lies flat on the floor. In the proper position the handle 20 should extend outwardly from the intersection of the floor and wall.

When the marker 1 is brought snugly against the resilient floor covering, it is noted that the curved or arcuate surface 20 smoothly fits against and is capable of riding easily on the curved portion 50*b* of the resilient floor covering, and that the front faces press the upwardly curled portion 50*a* of the resilient floor covering against the lower most portion of the vertical wall 52. The vertical front faces have sufficient height so that it can firmly hold the upturned flooring against the wall. Likewise, the smooth base surface will hold the edge of the flooring against the floor.

Once properly positioned the marker 1 is then moved parallel to the wall and along the floor with forward—downward pressure keeping the base flat on the floor and the marking pen against the now partly pressed down upturned edge. The pen 30 will mark a line along the flooring, on this up turned edge and if properly operated, this traced line will provide an accurate mark along which the flooring can be trimmed, to provide the desired fit against the wall.

A variety of factors come into play when determining how to trim the flooring, including thickness of the flooring, the tightness of the fit desired against the wall depending on the type of molding or edging which will be used, and the texture of the particular flooring. Each of these factors must be considered, when setting the height of the marker, and its outward extent.

In order to eliminate the guess work and estimating involved in the locating of the proper point of contact of the pen and the flooring, it is essential that the base surface 11 meets or intersects with the arculate surface 15, at a point having a horizontal straight-line distance (AO) to the vertical plane containing the vertical front surface. The straight line distance (AO) is equal to the arc length as measured along the upturned flooring. Such straight line distance (AO) and the arc-length are equal to the radius of the quarter cylinder which forms the curved or arculate surface.

If such distances are precisely measured and obtained, then the resilient floor covering will be marked precisely and accurately without any guess work or estimating, and the cut and trimmed edge of the resilient floor covering will precisely and accurately come to rest in a horizontal configuration wherein it abuts perfectly against the very lowermost portion of the wall.

While the invention has been described with reference to its preferred embodiment thereof, it will be appreciated by those of ordinary skill in the art that various changes can be made in the process and apparatus without departing from the basic spirit and scope of the invention.

What is claimed is:

1. A wall edge marking device for marking a line along resilient floor covering for subsequent cutting comprising in combination:

a flat, horizontally planar, relatively smooth base surface capable of sliding along the surface of a resilient floor covering laid flat out on a floor;

a pair of flat vertically planar, relatively smooth front faces each in planes substantially perpendicular to said flat horizontally planar relatively smooth base surface each of the faces of said pair in angular relation to the other, forming at their intersection a vertical edge, said vertical edge capable of sliding along the surface of a portion of said resilient floor covering which is curled upwardly partly along the lower most portion of a wall abutting said floor;

said flat horizontally planar, relatively smooth base surface, and said flat vertically planar relatively smooth pair of front faces, possessing sufficient flat planar surfaces whereby said wall edge marker is capable of steady, stable, non-rocking, sliding motion along the surface of said resilient floor covering;

a relatively smooth arcuate surface in the form of a quarter cylinder connecting said flat horizontally planar, relatively smooth base surface and said pair of flat vertically planar relatively smooth front faces;

an axial marking instrument having a marking point intersecting said arcuate surface and extending from within said wall edge device to appoint beyond said arcuate surface;

a first means for adjusting the point of intersection of said marker and said arcuate surface, along said arcuate surface;

a second means for adjusting the extension of said marking instrument through said arcuate surface along the major axis of said marking instrument;

said first and second means constructed and arranged so that the straight line distance from the intersection of said arcuate surface and said flat, horizontally planar relatively smooth base surface to said lower most portion of the wall is equal to the arc distance from the intersection of said flat horizontally planar, relatively smooth base surface and said arcuate surface, to said intersection of said marking instrument and said arcuate surface, as measured along said arcuate surface; said straightline distance and said arcuate distance being equal in length to the radius of said quarter cylinder.

2. A wall edge marking device in accordance with claim 1 wherein:

said first adjusting means includes an adjustable receptacle for housing said marking instrument; mounting means for securely positioning said adjustable pen receptacle in said marking device in a preselected position.

3. A wall edge marking device in accordance with claim 2 wherein:

said second adjusting means includes an adjustable set screw positioned at the axial end of said marking instrument opposite said marking point, and secured in said adjustable receptacle.

* * * * *